US012376620B2

(12) United States Patent
Hepworth

(10) Patent No.: US 12,376,620 B2
(45) Date of Patent: Aug. 5, 2025

(54) AEROSOL PROVISION DEVICES WITH A SUBSTANCE OF 8-12 DENIER AND A FIRST AND SECOND TUBE PORTION EXTENDING THEREFROM

(71) Applicant: NICOVENTURES TRADING LIMITED, London (GB)

(72) Inventor: Richard Hepworth, Southampton (GB)

(73) Assignee: NICOVENTURES TRADING LIMITED, London (GB)

( * ) Notice: Subject to any disclaimer, the term of this patent is extended or adjusted under 35 U.S.C. 154(b) by 876 days.

(21) Appl. No.: 16/333,563

(22) PCT Filed: Sep. 13, 2017

(86) PCT No.: PCT/EP2017/073061
§ 371 (c)(1),
(2) Date: Mar. 14, 2019

(87) PCT Pub. No.: WO2018/050720
PCT Pub. Date: Mar. 22, 2018

(65) Prior Publication Data

US 2019/0230990 A1 Aug. 1, 2019

(30) Foreign Application Priority Data

Sep. 14, 2016 (GB) ..... 1615609

(51) Int. Cl.
*A24D 3/06* (2006.01)
*A24D 3/17* (2020.01)
(Continued)

(52) U.S. Cl.
CPC ..... *A24D 3/061* (2013.01); *A24D 3/17* (2020.01); *A24F 40/00* (2020.01); *A24F 40/30* (2020.01); *A24F 40/42* (2020.01); *A24F 40/10* (2020.01)

(58) Field of Classification Search
None
See application file for complete search history.

(56) References Cited

U.S. PATENT DOCUMENTS 3,894,544 A 7/1975 Egri
4,145,518 A * 3/1979 Morie ..... A24D 3/08 131/343
(Continued)

FOREIGN PATENT DOCUMENTS

AR 089648 A1 9/2014
AR 091949 A1 3/2015
(Continued)

OTHER PUBLICATIONS

JP H05211861 NPL (Year: 1994).*
(Continued)

*Primary Examiner* — Xiao S Zhao
*Assistant Examiner* — Guy F Mongelli
(74) *Attorney, Agent, or Firm* — MERCHANT & GOULD P.C.

(57) ABSTRACT

There is described a substance container for an aerosol provision device for providing an inhalable medium including an aerosol. The substance container includes a body of material that is permeable so as to allow the aerosol generated in the device to flow into and through the body of material and a substance in the body of material for modifying a property of the aerosol when the aerosol flows through the body of material.

12 Claims, 3 Drawing Sheets

(51) Int. Cl.

| | |
|---|---|
| ***A24F 40/00*** | (2020.01) |
| ***A24F 40/10*** | (2020.01) |
| ***A24F 40/30*** | (2020.01) |
| ***A24F 40/42*** | (2020.01) |

(56) References Cited

U.S. PATENT DOCUMENTS 4,181,640 A * 1/1980 Morie ..... A24D 3/08 525/437
4,188,960 A * 2/1980 Morie ..... B01D 39/1623 131/345
4,338,931 A 7/1982 Cavazza
4,714,082 A * 12/1987 Banerjee ..... A24D 1/18 131/365
5,099,861 A * 3/1992 Clearman ..... A24D 1/22 131/194
5,392,793 A * 2/1995 Molloy ..... A24D 3/045 131/334
5,632,287 A * 5/1997 Hayworth ..... A24D 1/00 131/360
6,382,465 B1 5/2002 Greiner-Perth
6,532,965 B1 3/2003 Abhulimen et al.
6,606,992 B1 8/2003 Schuler et al.
6,705,313 B2 3/2004 Niccolai
6,708,846 B1 3/2004 Fuchs et al.
7,726,320 B2 6/2010 Robinson et al.
8,051,857 B1 * 11/2011 Baptiste ..... A24F 17/00 131/365
8,377,009 B2 2/2013 Sullivan et al.
8,499,766 B1 8/2013 Newton
8,997,753 B2 4/2015 Li et al.
8,997,754 B2 4/2015 Tucker et al.
9,004,073 B2 4/2015 Tucker et al.
9,247,773 B2 2/2016 Memari et al.
9,282,772 B2 3/2016 Tucker et al.
9,693,587 B2 7/2017 Plojoux et al.
10,010,687 B2 7/2018 Von Schuckmann
10,015,990 B2 7/2018 Mironov
10,172,390 B2 1/2019 Nakano et al.
10,368,583 B2 8/2019 Takeuchi et al.
10,426,199 B2 10/2019 Turner et al.
10,470,491 B2 11/2019 Sutton et al.
10,492,526 B2 12/2019 Sampson et al.
10,758,686 B2 9/2020 Reevell
2004/0173229 A1 * 9/2004 Crooks ..... A24B 15/286 131/342
2005/0000518 A1 1/2005 Dunkley et al.
2005/0016533 A1 1/2005 Schuler et al.
2005/0022813 A1 2/2005 Alston
2005/0048003 A1 3/2005 Ohki et al.
2005/0056280 A1 3/2005 Alston et al.
2005/0081852 A1 4/2005 Rangachari
2005/0121044 A1 * 6/2005 Banerjee ..... B82Y 30/00 131/334
2005/0150492 A1 7/2005 Dunkley et al.
2006/0174901 A1 * 8/2006 Karles ..... A24D 3/061 131/337
2007/0012327 A1 1/2007 Karles et al.
2007/0186945 A1 * 8/2007 Olegario ..... A24D 1/00 131/362
2008/0092912 A1 * 4/2008 Robinson ..... A24D 1/002 131/200
2010/0101589 A1 * 4/2010 Nelson ..... A24D 3/0216 131/84.4
2010/0154808 A1 * 6/2010 Boll ..... A24D 1/00 131/58
2011/0126848 A1 * 6/2011 Zuber ..... A24F 40/46 131/329
2012/0118309 A1 * 5/2012 Taniguchi ..... A24D 3/10 131/342
2013/0042865 A1 2/2013 Monsees et al.
2013/0068081 A1 3/2013 Kronberg et al.
2013/0121608 A1 5/2013 Winnemoeller et al.
2013/0192615 A1 8/2013 Tucker et al.
2013/0192616 A1 8/2013 Tucker et al.
2013/0192619 A1 8/2013 Tucker et al.
2013/0192620 A1 8/2013 Tucker et al.
2013/0192621 A1 8/2013 Li et al.
2013/0192622 A1 8/2013 Tucker et al.
2013/0192623 A1 8/2013 Tucker et al.
2013/0298905 A1 11/2013 Levin et al.
2013/0312742 A1 11/2013 Monsees et al.
2014/0060554 A1 * 3/2014 Collett ..... A24F 40/30 131/328
2014/0131579 A1 5/2014 Ademe et al.
2014/0202478 A1 * 7/2014 Awty ..... A24D 3/04 131/332
2014/0202479 A1 7/2014 Nicholls et al.
2014/0261475 A1 * 9/2014 Kizer ..... A24D 3/14 264/122
2014/0261486 A1 * 9/2014 Potter ..... A24F 40/30 131/328
2014/0326260 A1 * 11/2014 Gladden ..... A24B 15/165 431/253
2015/0027468 A1 * 1/2015 Li ..... A24D 3/063 131/329
2015/0027469 A1 1/2015 Tucker et al.
2015/0027477 A1 * 1/2015 Yoshino ..... A24D 3/061 131/337
2015/0083150 A1 3/2015 Conner et al.
2015/0245654 A1 9/2015 Memari et al.
2015/0245655 A1 9/2015 Memari et al.
2015/0245656 A1 9/2015 Memari et al.
2015/0245657 A1 9/2015 Memari et al.
2015/0245662 A1 9/2015 Memari et al.
2015/0245663 A1 9/2015 Memari et al.
2015/0245664 A1 9/2015 Memari et al.
2015/0245665 A1 9/2015 Memari et al.
2015/0245666 A1 9/2015 Memari et al.
2015/0245667 A1 9/2015 Memari et al.
2015/0245668 A1 9/2015 Memari et al.
2015/0313281 A1 11/2015 Bonici et al.
2015/0359266 A1 12/2015 Memari et al.
2015/0374035 A1 12/2015 Sanchez et al.
2016/0007648 A1 1/2016 Sutton et al.
2016/0037824 A1 * 2/2016 Jordil ..... A24D 3/062 131/335
2016/0073684 A1 * 3/2016 Mironov ..... A24C 5/474 131/58
2016/0206004 A1 * 7/2016 Shinkawa ..... A24F 40/30
2017/0347706 A1 12/2017 Aoun et al.
2017/0360088 A1 * 12/2017 Pijnenburg ..... A24F 40/42
2018/0007974 A1 1/2018 Thorens
2018/0027882 A1 2/2018 Hepworth et al.
2018/0279678 A1 10/2018 Hepworth et al.
2018/0352856 A1 * 12/2018 Sebastian ..... A24F 7/04
2018/0360122 A1 12/2018 Aoun et al.
2019/0098930 A1 4/2019 Fallon et al.
2019/0125988 A1 5/2019 Trzecieski
2019/0254343 A1 8/2019 Hepworth et al.
2019/0254344 A1 8/2019 Hepworth et al.
2019/0254345 A1 8/2019 Hepworth et al.
2019/0274350 A1 * 9/2019 Duc ..... A24C 5/00
2020/0046026 A1 2/2020 Pijnenburg et al.
2020/0060333 A1 2/2020 Sutton et al.
2020/0138009 A1 * 5/2020 Schultheiss ..... B66D 3/26
2020/0390149 A1 12/2020 Hepworth et al.

FOREIGN PATENT DOCUMENTS

AU 2013214984 A1 8/2014
AU 2013214987 A1 8/2014
AU 2013214991 A1 8/2014
AU 2013214993 A1 8/2014
AU 2013214994 A1 8/2014
AU 2013214997 A1 8/2014
AU 2013214998 A1 8/2014
CA 2845090 A1 2/2013
CA 2862105 A1 8/2013
CA 2862294 A1 8/2013
CA 2863185 A1 8/2013
CA 2863189 A1 8/2013

(56) References Cited

FOREIGN PATENT DOCUMENTS

| | | | | | |
|---|---|---|---|---|---|
| CA | 2867620 | A1 | | 8/2013 | |
| CA | 2867624 | A1 | | 8/2013 | |
| CA | 2868313 | A1 | | 8/2013 | |
| CN | 2760984 | Y | | 3/2006 | |
| CN | 104219973 | A | | 12/2014 | |
| CN | 104244749 | A | | 12/2014 | |
| CN | 104244750 | A | | 12/2014 | |
| CN | 104284606 | A | | 1/2015 | |
| CN | 104302197 | A | | 1/2015 | |
| CN | 104394722 | A | | 3/2015 | |
| CN | 204275207 | U | | 4/2015 | |
| CN | 104661544 | A | | 5/2015 | |
| CN | 204560971 | U | | 8/2015 | |
| CN | 104968225 | A | | 10/2015 | |
| DE | 60310596 | | * | 10/2007 | |
| EA | 201490448 | A1 | | 12/2014 | |
| EP | 0636324 | | * | 2/1995 | ..... A24D 3/04 |
| EP | 0636324 | A | * | 2/1995 | |
| EP | 1555899 | B1 | | 12/2006 | |
| EP | 2083643 | A1 | | 8/2009 | |
| EP | 2723429 | A1 | | 4/2014 | |
| EP | 2727619 | A2 | | 5/2014 | |
| EP | 2740506 | A1 | | 6/2014 | |
| EP | 2740507 | A1 | | 6/2014 | |
| EP | 2740508 | A1 | | 6/2014 | |
| EP | 2727619 | A3 | | 7/2014 | |
| EP | 2756859 | A1 | | 7/2014 | |
| EP | 2756860 | A1 | | 7/2014 | |
| EP | 2809180 | A1 | | 12/2014 | |
| EP | 2809182 | A2 | | 12/2014 | |
| EP | 2809183 | A1 | | 12/2014 | |
| EP | 2809184 | A1 | | 12/2014 | |
| EP | 2809185 | A1 | | 12/2014 | |
| EP | 2809186 | A1 | | 12/2014 | |
| EP | 2809187 | A1 | | 12/2014 | |
| EP | 2723429 | A4 | | 4/2015 | |
| EP | 2809180 | A4 | | 7/2015 | |
| EP | 2809184 | A4 | | 7/2015 | |
| EP | 2809187 | A4 | | 7/2015 | |
| EP | 2809182 | A4 | | 8/2015 | |
| EP | 2809183 | A4 | | 8/2015 | |
| EP | 2809185 | A4 | | 8/2015 | |
| EP | 2809186 | A4 | | 9/2015 | |
| EP | 2948006 | A1 | | 12/2015 | |
| EP | 2964038 | A1 | | 1/2016 | |
| EP | 2975956 | A1 | | 1/2016 | |
| EP | 3039972 | A1 | | 7/2016 | |
| GB | 2394394 | | * | 4/2004 | |
| GB | 2394394 | A | * | 4/2004 | ..... A24D 3/04 |
| GB | 201413018 | | | 9/2014 | |
| GB | 201413019 | | | 9/2014 | |
| GB | 201413021 | | | 9/2014 | |
| GB | 201413025 | | | 9/2014 | |
| GB | 201413027 | | | 9/2014 | |
| GB | 201413028 | | | 9/2014 | |
| GB | 201413030 | | | 9/2014 | |
| GB | 201413032 | | | 9/2014 | |
| GB | 201413034 | | | 9/2014 | |
| GB | 201413036 | | | 9/2014 | |
| GB | 201413037 | | | 9/2014 | |
| GB | 2513061 | A | | 10/2014 | |
| GB | 2523585 | A | | 9/2015 | |
| GB | 2523585 | A8 | | 9/2015 | |
| GB | 2525080 | A | | 10/2015 | |
| GB | 2525294 | A | | 10/2015 | |
| GB | 2525295 | A | | 10/2015 | |
| GB | 2525480 | A | | 10/2015 | |
| GB | 2525722 | A | | 11/2015 | |
| GB | 2525723 | A | | 11/2015 | |
| GB | 2525724 | A | | 11/2015 | |
| GB | 2525725 | A | | 11/2015 | |
| GB | 2525726 | A | | 11/2015 | |
| GB | 2525727 | A | | 11/2015 | |
| GB | 2529919 | A | | 3/2016 | |
| GB | 2531633 | A | | 4/2016 | |
| HK | 1197203 | A1 | | 1/2015 | |
| HK | 1198138 | A1 | | 3/2015 | |
| HK | 1198142 | A1 | | 3/2015 | |
| HK | 1198143 | A1 | | 3/2015 | |
| HK | 1200128 | A1 | | 7/2015 | |
| HK | 1200129 | A1 | | 7/2015 | |
| HK | 1203128 | A1 | | 10/2015 | |
| IL | 233651 | | | 8/2014 | |
| IL | 233896 | | | 9/2014 | |
| IL | 230930 | A | | 6/2017 | |
| IL | 233851 | A | | 6/2019 | |
| IL | 233653 | A | | 4/2020 | |
| IL | 233885 | A | | 5/2020 | |
| IL | 233894 | A | | 5/2020 | |
| IL | 233895 | A | | 5/2020 | |
| JP | S4991583 | U | | 8/1974 | |
| JP | S5736898 | U | | 2/1982 | |
| JP | S6033891 | U | | 3/1985 | |
| JP | S60127794 | U | | 8/1985 | |
| JP | H022331 | A | | 1/1990 | |
| JP | H05211861 | | * | 8/1993 | ..... H05K 3/0079 |
| JP | 2006503572 | A | | 2/2006 | |
| JP | 2010506594 | A | | 3/2010 | |
| JP | 2010536336 | A | | 12/2010 | |
| JP | 2012507287 | A | | 3/2012 | |
| JP | 2014524313 | A | | 9/2014 | |
| JP | 2014532433 | A | | 12/2014 | |
| JP | 2015503335 | A | | 2/2015 | |
| JP | 2015505474 | A | | 2/2015 | |
| JP | 2015505475 | A | | 2/2015 | |
| JP | 2015505476 | A | | 2/2015 | |
| JP | 2015506182 | A | | 3/2015 | |
| JP | 2015508641 | A | | 3/2015 | |
| JP | 2015512617 | A | | 4/2015 | |
| JP | 2015513393 | A | | 5/2015 | |
| JP | 2015518730 | A | | 7/2015 | |
| JP | 2015523089 | | | 8/2015 | |
| JP | 2015523089 | A | | 8/2015 | |
| JP | 2015536154 | A | | 12/2015 | |
| JP | 2016509852 | A | | 4/2016 | |
| JP | 2016510994 | A | | 4/2016 | |
| JP | 2016517701 | A | | 6/2016 | |
| JP | 2016523565 | | | 8/2016 | |
| JP | 2016523565 | A | | 8/2016 | |
| JP | 2018166509 | | * | 1/2018 | |
| KR | 20140070543 | A | | 6/2014 | |
| KR | 20140090138 | A | | 7/2014 | |
| KR | 20140125822 | A | | 10/2014 | |
| KR | 20140125827 | A | | 10/2014 | |
| KR | 20140125828 | A | | 10/2014 | |
| KR | 20140125829 | A | | 10/2014 | |
| KR | 20140127288 | A | | 11/2014 | |
| KR | 20150003845 | A | | 1/2015 | |
| KR | 20150005514 | A | | 1/2015 | |
| KR | 20150035488 | A | | 4/2015 | |
| KR | 1020160098203 | | | 8/2016 | |
| MA | 20150054 | A1 | | 2/2015 | |
| MA | 20150055 | A1 | | 2/2015 | |
| MA | 20150056 | A1 | | 2/2015 | |
| MA | 20150057 | A1 | | 2/2015 | |
| MA | 20150058 | A1 | | 2/2015 | |
| MA | 20150153 | A1 | | 5/2015 | |
| MA | 20150169 | A1 | | 6/2015 | |
| MX | 2014009396 | A | | 2/2015 | |
| MX | 2014009398 | A | | 2/2015 | |
| MX | 2014009393 | A | | 5/2015 | |
| MX | 2014009394 | A | | 5/2015 | |
| MX | 2014009397 | A | | 5/2015 | |
| NL | 8301145 | A | * | 11/1983 | ..... A24D 3/043 |
| NZ | 627439 | A | | 9/2015 | |
| NZ | 628058 | A | | 1/2016 | |
| RU | 157882 | U1 | | 12/2015 | |
| RU | 2581999 | C2 | | 4/2016 | |
| SG | 2014013627 | A | | 7/2014 | |
| TW | 201315397 | A | | 4/2013 | |
| WO | 2000053037 | A1 | | 9/2000 | |
| WO | WO-2010045671 | A1 | | 4/2010 | |
| WO | WO-2012156695 | A1 | | 11/2012 | |
| WO | WO-2013020280 | A1 | | 2/2013 | |

(56) References Cited

FOREIGN PATENT DOCUMENTS

| | | | | | |
|---|---|---|---|---|---|
| WO | WO-2013025921 | A1 | | 2/2013 | |
| WO | WO-2013068081 | A1 | | 5/2013 | |
| WO | WO-2013068100 | A1 | | 5/2013 | |
| WO | WO-2013098405 | A2 | | 7/2013 | |
| WO | 2013121698 | | | 8/2013 | |
| WO | WO-2013116558 | A1 | | 8/2013 | |
| WO | WO-2013116561 | A1 | | 8/2013 | |
| WO | WO-2013116565 | A1 | | 8/2013 | |
| WO | WO-2013116567 | A1 | | 8/2013 | |
| WO | WO-2013116568 | A2 | | 8/2013 | |
| WO | WO-2013116571 | A1 | | 8/2013 | |
| WO | WO-2013116572 | A1 | | 8/2013 | |
| WO | WO-2013120566 | A2 | | 8/2013 | |
| WO | WO-2013121608 | A1 | | 8/2013 | |
| WO | WO-2013138384 | A2 | | 9/2013 | |
| WO | WO-2013138384 | A3 | | 10/2013 | |
| WO | WO-2013156339 | A1 | | 10/2013 | |
| WO | WO-2013164630 | A1 | * | 11/2013 | ..... A24D 3/04 |
| WO | 2013179524 | | | 12/2013 | |
| WO | WO-2013179524 | A1 | | 12/2013 | |
| WO | WO-2014116974 | A1 | | 7/2014 | |
| WO | WO-2014140273 | A2 | | 9/2014 | |
| WO | 2014154887 | A1 | | 10/2014 | |
| WO | WO-2014157051 | A1 | * | 10/2014 | ..... H05K 3/0079 |
| WO | WO-2014158051 | A1 | * | 10/2014 | ..... A24D 3/04 |
| WO | WO-2014159250 | A1 | | 10/2014 | |
| WO | WO-2013116568 | A3 | | 11/2014 | |
| WO | WO-2014184239 | A1 | | 11/2014 | |
| WO | WO-2015013108 | A2 | | 1/2015 | |
| WO | WO-2015013108 | A3 | | 4/2015 | |
| WO | WO-2015047954 | A1 | | 4/2015 | |
| WO | WO-2015128665 | A1 | | 9/2015 | |
| WO | WO-2015128666 | A1 | | 9/2015 | |
| WO | WO-2015128667 | A1 | | 9/2015 | |
| WO | WO-2016024083 | A1 | | 2/2016 | |
| WO | WO-2016076178 | A1 | | 5/2016 | |
| WO | 2016084120 | | | 6/2016 | |
| WO | WO-2016084120 | A1 | | 6/2016 | |
| WO | 2016135342 | A2 | | 9/2016 | |
| WO | WO-2017149152 | A1 | | 9/2017 | |
| WO | WO-2017160559 | A1 | | 9/2017 | |
| WO | 2017198838 | | | 11/2017 | |
| WO | 2017198838 | A1 | | 11/2017 | |

OTHER PUBLICATIONS

JP H05211861 translation (Year: 2023).*
NL-8301145-A translation (Year: 2023).*
Application and File History for U.S. Appl. No. 16/333,570, filed Mar. 24, 2019, Inventor: Hepworth et al.
Application and File History for U.S. Appl. No. 16/333,567, filed Mar. 24, 2019, Inventor: Hepworth et al.
Application and File History for U.S. Appl. No. 16/333,568, filed Mar. 24, 2019, Inventor: Hepworth et al.
Application for U.S. Appl. No. 16/333,563, filed Mar. 14, 2019, inventors Hepworth, et al.
Communication pursuant to Article 94(3) EPC for Application No. 1778008.3, dated Sep. 11, 2020, 8 pages.
International Preliminary Report on Patentability for Application No. PCT/EP2017/073057, dated Mar. 28, 2019, 9 pages.
International Preliminary Report on Patentability for Application No. PCT/EP2017/072811, dated Aug. 20, 2018, 7 pages.
International Preliminary Report on Patentability for Application No. PCT/EP2017/072814, dated Nov. 30, 2018, 8 pages.
International Preliminary Report on Patentability for Application No. PCT/EP2017/072813, dated Nov. 30, 2018, 9 pages.
International Preliminary Report on Patentabilityfor Application No. PCT/EP2017/073061, dated Mar. 28, 2019, 7 pages.
International Search Report and Written Opinion for Application No. PCT/EP2017/072811, dated Dec. 11, 2017, 15 pages.
International Search Report and Written Opinion for Application No. PCT/EP2017/072813, dated Dec. 11, 2017, 12 pages.
International Search Report and Written Opinion for Application No. PCT/EP2017/072814, dated Dec. 11, 2017, 12 pages.
International Search Report and Written Opinion for Application No. PCT/EP2017/073057, dated Feb. 7, 2018, 16 pages.
International Search Report and Written Opinion for Application No. PCT/EP2017/073061, dated Jan. 8, 2018, 13 pages.
Korean Office Action dated Oct. 26, 2020 for Korean Application No. 10-2019-7010642 27 pages.
Korean Office Action dated Oct. 26, 2020 for Korean Application No. 10-2019-7010644, 21 pages.
Notice of Reasons for Rejection for Japanese Application No. 2019-535975, dated Jul. 7, 2020, 9 pages.
Office Action For Korean Application No. 10-2019-7010649, dated Jan. 19, 2021, 7 pages.
Office Action dated Feb. 2, 2021 for Japanese Application No. JP2019-513828, 7 pages.
Office Action dated Aug. 20, 2020 for Russian Application No. 2019107330, 13 pages.
Office Action dated Jul. 21, 2020 for European Application No. 17780009.1, 7 pages.
Office Action dated Jul. 21, 2020 for Japanese Application No. 2019-513761, 11 pages.
Office Action dated Jul. 21, 2020 for Japanese Application No. 2019-513827, 9 pages.
Office Action dated Jul. 21, 2020 for Japanese Application No. 2019-513842, 11 pages.
Office Action dated Jul. 7, 2020 for Japanese Application No. JP2019-513828, 12 pages.
Search Report dated Mar. 2, 2018 for Great Britain Application No. GB1615609.3, 4 pages.
Office Action For Japanese Application No. 2019-535975, dated Oct. 19, 2021, 4 pages.
Notice of Reasons for Refusal for Japanese Application No. 2019-535975, mailed on Apr. 12, 2022, 18 pages.
"Notice of Opposition received for European Patent Application No. 17780311.1, mailed on Jan. 17, 2023", 1 page.
KR Final Rejection in KR Appln. No. 10-2021-7912725, dated Nov. 25, 2021, 6 pages.
JP Final Rejection in JP Appln. No. 2019-535975, dated Mar. 9, 2021, 2 pages.
EP Communication pursuant to Rule 114(2) EPC in EP Appln. No. 17780630.4, dated Jun. 28, 2021, 9 pages.
EP Notice of Opposition in European Application No. 17780630.4, dated Jan. 24, 2025, 35 pages.

* cited by examiner

AEROSOL PROVISION DEVICES WITH A SUBSTANCE OF 8-12 DENIER AND A FIRST AND SECOND TUBE PORTION EXTENDING THEREFROM

PRIORITY CLAIM

The present application is a National Phase entry of PCT Application No. PCT/EP2017/073061, filed Sep. 13, 2017, which claims priority from GB Patent* Application No. 1615609.3, filed Sep. 14, 2016, which is hereby fully incorporated herein by reference.

TECHNICAL FIELD

The present disclosure relates to a container, and more particularly to a container for an apparatus for generating an inhalable material.

BACKGROUND

Smoking articles such as cigarettes, cigars and the like burn tobacco during use to create tobacco smoke. Attempts have been made to provide alternatives to these articles that burn tobacco by creating products that release compounds without burning. Examples of such products are heating devices which release compounds by heating, but not burning, the material. The material may be for example tobacco or other non-tobacco products, which may or may not contain nicotine.

As another example, there are so-called e-cigarette devices. These devices typically contain a liquid which is heated to vaporize the liquid to produce an inhalable vapor or aerosol. The liquid may contain nicotine and/or flavorings and/or aerosol-generating substances, such as glycerol. The known e-cigarette devices typically do not contain or use tobacco.

SUMMARY

According to a first aspect of the present disclosure, there is provided a substance container for an aerosol provision device for providing an inhalable medium comprising an aerosol, the substance container comprising: a body of material that is permeable so as to allow the aerosol generated in the device to flow into and through the body of material and; a substance in the body of material for modifying a property of the aerosol when the aerosol flows through the body of material.

According to a second aspect of the disclosure, there is provided an aerosol provision device for providing an inhalable medium comprising an aerosol; the device comprising such a container.

Further features and advantages of the disclosure will become apparent from the following description of embodiments of the disclosure, given by way of example only, which is made with reference to the accompanying drawings. Like features appearing in different ones of the drawings are giving the same reference numerals in the different drawings.

DETAILED DESCRIPTION

Figure 1:
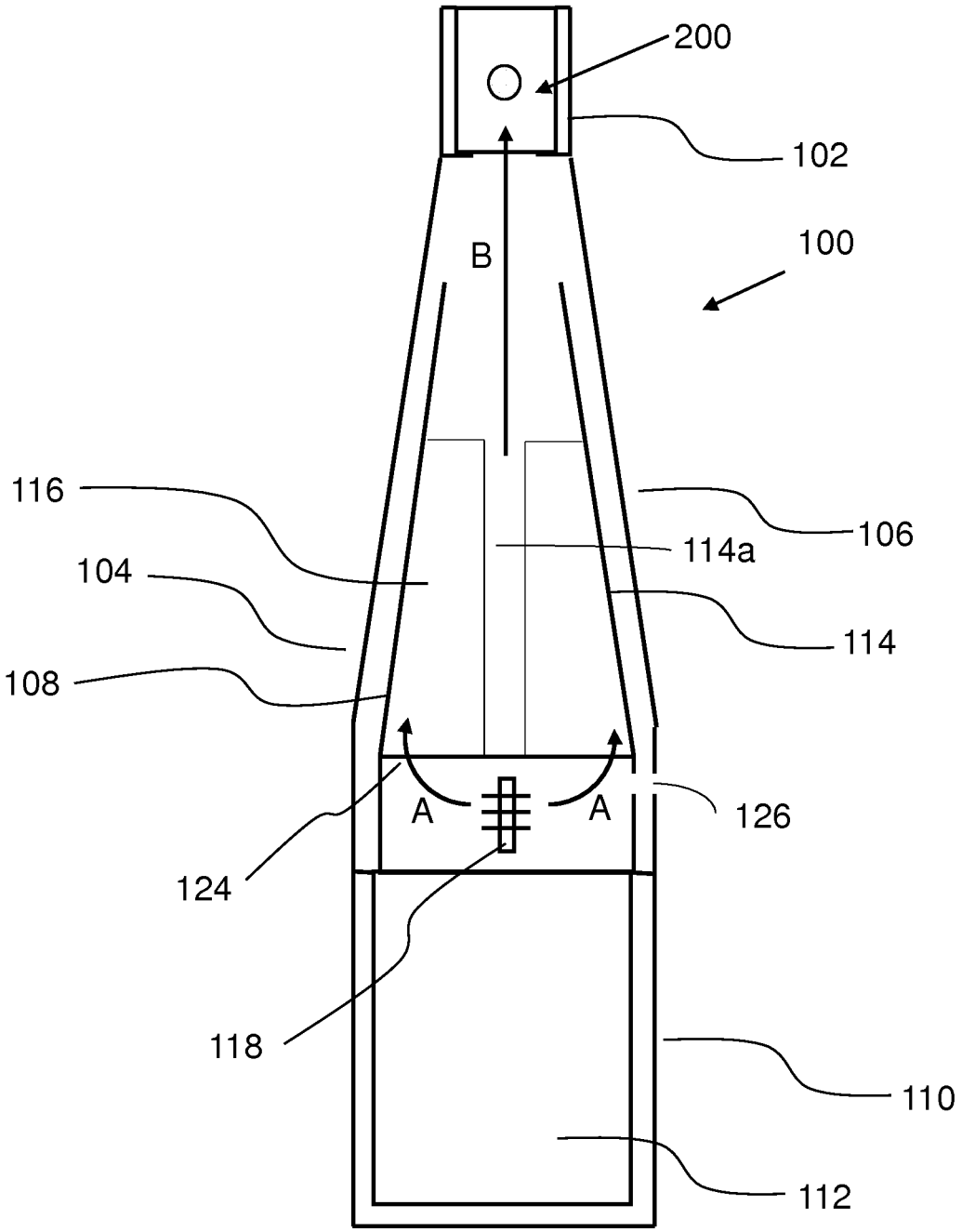
FIG. 1 shows a schematic of an exemplary aerosol provision device.

Referring to FIG. 1, a schematic of an aerosol provision device 100 is illustrated. The aerosol provision device 100 is an inhalation device (i.e. a user uses it to inhale an aerosol provided by the device 100) and the device 100 is a hand held device. In this example, the device 100 is an electronic device, for example an electronic cigarette 100.

In broad outline, the device 100 volatilizes a liquid to form a vapor or an aerosol which passes through a flavor container 200 received, for example, in a mouthpiece 102 of the device 100. In at least some examples a vapor is produced that then at least partly condenses to form an aerosol before exiting the device 100. The flavor container 200 imparts a flavor to the vapor or aerosol passing through the mouthpiece 102 for inhalation by a user.

In this respect, first it may be noted that, in general, a vapor is a substance in the gas phase at a temperature lower than its critical temperature, which means that for example the vapor can be condensed to a liquid by increasing its pressure without reducing the temperature. On the other hand, in general, an aerosol is a colloid of fine solid particles or liquid droplets, in air or another gas. A colloid is a substance in which microscopically dispersed insoluble particles are suspended throughout another substance.

For reasons of convenience, as used herein the term aerosol should be taken as meaning an aerosol, a vapor or a combination of an aerosol and vapor.

Returning to FIG. 1, the device 100 comprises an outer body or housing 104 comprising an upper portion 106 housing a cartridge 108 and a lower portion 110 housing a battery portion 112. The cartridge 108 is connected to, but removable from, the battery portion 112. In this example, at least the upper portion 106 of the outer body 104 may be removed so as to expose the cartridge 108, and hence allow installation, removal and/or replacement of the cartridge 108. The cartridge 108 has a liquid container 114 for containing e-cigarette liquid 116.

The device 100 has the mouthpiece 102 removably connected to the upper portion 106 of the outer body 104. The mouthpiece 102 has received therein the flavor container 200 for imparting a flavor to a flow of aerosol that passes through the mouthpiece 102. Examples of flavor elements 200 will be discussed in more detail below.

The device 100 is arranged so that as the liquid 116 is volatilized so as to produce an aerosol at least some or all or substantially all of the aerosol or passes through the flavor container 200 received in the mouthpiece 102 for example so as to entrain constituents of the flavor container 200 therein.

The liquid container 114 is provided generally centrally of the cartridge 108. The liquid container 114 is frusto-conical in shape, but may have a different shape, such as conical, cylindrical, etc. The liquid container 114 is annular in shape and defines a cylindrical channel 114*a* running through the length of the liquid container 114. The liquid container 114 may be formed of rigid, watertight and airtight materials, such as metal, suitable plastics, etc.

The cartridge 108 is provided with a heater 118 and a wick (not shown) in (thermal) contact with the heater 118. In this example, the heater 118 and the wick are provided as a single unit, sometimes known as an "atomizer". In this case, where the cartridge 108 includes an atomizer, such a cartridge 108 is often referred to as a "cartomizer".

The orientation of the heater 118 is shown schematically and for example the heater 118 may be a coil having its longitudinal axis perpendicular or parallel to the longitudinal axis of the cartridge 108.

The wick (not shown) is in contact with the liquid 116. This may be achieved, for example, by the wick (not shown) being inserted through a through hole (not shown) in an end wall 124 of the liquid container 114. Alternatively or additionally, the end wall 124 may be a porous member which allows liquid to pass through from the liquid container 114, and the wick (not shown) may be in contact with the porous end wall 124. The end wall 124 may be for example in the form of a porous ceramic disk. A porous end wall 124 of this type helps to regulate the flow of liquid onto the wick (not shown). The wick (not shown) is generally absorbent and acts to draw in liquid 116 from the liquid container 114 by capillary action (shown schematically in FIG. 1 by arrows A). The wick can be non-woven and may be for example a cotton or wool material or the like, or a synthetic material, including for example polyester, nylon, viscose, polypropylene or the like, or a ceramic material.

The cartridge 104 is (electrically) connected to a battery in the battery portion 112 to enable the heater 118 to be powered. When the heater 118 is powered (which may be instigated for example by the user operating a button (not shown) of the device 100 or by a puff detector (not shown) of the overall device 100, as is known per se), liquid 116 drawn (shown in FIG. 1 by arrows A) in from the liquid container 114 by the wick and is heated by the heater 118 to volatilize or vaporize the liquid, so as to generate an aerosol.

In use, the liquid 116 may be heated to a temperature of between around 100-300° C. or more particularly around 150° C. to 250° C. The liquid 116 may, or may not, comprise nicotine.

As the user draws on the mouthpiece 102, air is drawn through an air inlet 126. The liquid 116 is volatized or vaporized by the heater 110 into the air from the air inlet 126 thereby to produce a flow of an aerosol. The flow of aerosol is drawn through a channel 114*a* of the liquid container 114, through the flavor container 200 received in the mouthpiece 102, and out from the device 100 for inhalation by a user (this flow is shown by arrow B in FIG. 1).

The aerosol picks up (entrains) flavor (and/or other constituents) from a flavor substance in flavor container 200. One or more constituents of the flavor substance is thereby mixed with the flow of the aerosol thereby enhancing the sensory experience of a user. Advantageously, this enables a user to quickly add or modify a flavor sensation without having to first change the liquid 116 and in a way that reduces the likelihood of there being a thermal breakdown of that flavor that can sometimes occur with flavor provided in the actual liquid 116 following repeated use of the device 1.

Figure 2:
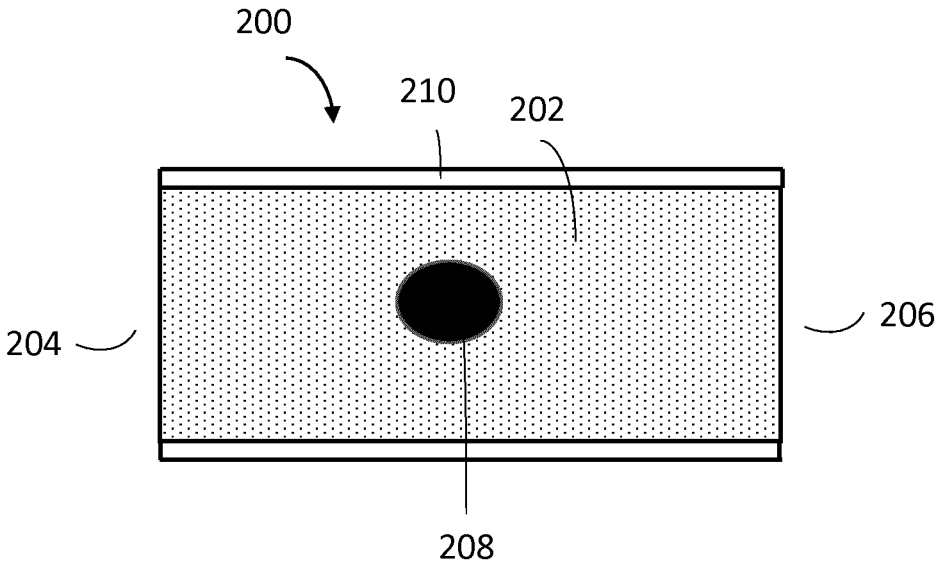
FIG. 2 shows a schematic sectional view of an example of a flavor container.

FIG. 2 illustrates an example of a flavor container 200 that can be used in the device 100 as described above.

In this example, the flavor container 200 comprises an elongate body of material 202 the composition of which is such that, when in use in the device 100, the aerosol stream generated in the device 100 is able to enter the flavor container 200 at an 'upstream' end 204, pass through the length of the flavor container 200, and exit the flavor container 200 at a 'downstream' end 206. In other words, the elongate body of material 202 is permeable to the flow of aerosol generated in the device 100.

In some examples, the elongate body 202 comprises a fibrous material and may be, for example, a fibrous material that is typically used as a filter material in a traditional combustible cigarette, examples including cellulose acetate fibers, polypropylene fibers, polyester fibers and paper, including crimped paper. Other materials that may be used include, for example, nylon and the like.

In this example, a first flavor component 208 is supported in the elongate body of material 202.

In one example, the first flavor component 208 is at least one flavor capsule that comprises an outer shell that encloses a flavor substance that comprises a flavorant. The flavor substance may be for example, a liquid, a gel, an emulsion, a suspension or beads. A user may, for example, manipulate the flavor container 200 in order to break the shell of the flavor capsule 208 in order to release the flavor substance into the material of the elongate body 202. In use, the flow of aerosol through the elongate body picks up (entrains) flavor (and/or other constituents) from the released flavor substance so that one or more constituents of the flavor substance is thereby mixed with the flow of the aerosol thereby enhancing the sensory experience of a user.

In an alternative example, the first flavor component 208 is again a flavor capsule that comprises an outer shell that encloses a substance that comprises a flavorant and, in use, the outer shell decomposes (e.g. melts) because of the heat of the aerosol flow to release the substance. Accordingly, in this example, there is no need for a user to manually break the capsule open.

In other examples, the flavor substance is not contained in a capsule. For example, the flavor substance may comprise a material that has been ground or otherwise treated so that it is in the form of particles, for example, powder, granules, grains, fibers, beads or the like particles which may be distributed substantially evenly throughout the elongate body of material 202 or concentrated in one or more particular sections of the body of material 202, for example the centre.

In some examples, such particles of flavor material may comprise tobacco although other botanicals or flavor agents may also be used.

In other examples, the flavor substance may comprises a gel or liquid or the like that is in body of material 202 but which is not released from a capsule.

In one example, the elongate body of material 202 comprises a continuous CA fiber formed into the elongate body of material 202 (e.g. the body of material 202 is what is known in the art as a 'dalmatian' type filter).

In another example, the elongate body of material 202 comprises a multiplicity of short cut CA fibers (e.g. fibers cut using a so called Turmalin apparatus) randomly orientated to form the elongate body of material 202.

An advantage of using short cut CA fibers is that a relatively small quantity of fibers are required to form the 'rod like' shape of the elongate body of material 202 that supports the first flavor component 208. This provides the benefit of a low pressure drop of the aerosol flow across the elongate body of material 202. Additionally, less (or indeed no) plasticizer, for example, triacetine is required to maintain this rod form than is required when using a continuous fiber CA.

In some examples the length of the elongate body of material 202 is in the range 10 mm to 20 mm and preferably in the range 12 mm to 15 mm.

In some examples, the cross-sectional diameter of the elongate body of material 202 is in the range 5 mm to 9 mm and preferably in the range 7.5 mm to 8 mm.

The tow cross section may, for example, be Y-shaped in cross section, X-shaped in cross section or Round shaped in cross section.

In some examples, when the flavor component 208 is a capsule, the capsule is substantially round 9 (i.e. spherical) in shape and its diameter is in the range 3 mm to 5 mm and preferably in the range of 3 mm to 4 mm. In other examples, when the flavor component 208 is a capsule, the capsule is substantially prolate (e.g. ellipsoid) in shape and its elongate length (i.e. that along its major axis) is in the range 3 mm to 5 mm and preferably in the range of 3 mm to 4 mm.

In some examples, the pressure difference across the length of the elongate body of material 202 when a user takes a draw (i.e. from the upstream end to the downstream end) is in the range of 0 to 40 mm water gauge (wg) or 0 to 30 mm water gauge (wg), preferably in the range of 5 to 20 mm water gauge (wg) and most preferably is in the range 10 to 20 mm wg. Alternatively, most preferably the pressure difference is in the range 5 to 15 mm wg.

In some examples, when the elongate body of material 202 comprises CA, the CA fiber used has a single Denier value in the range of 8-12 for a single strand (i.e. the CA fiber has a mass in grams of between 8-12 per 9000 meters of the CA fiber). This range of Denier is particularly convenient for obtaining the above described pressure differences.

The flavor container 200 may further comprise an outer wrapper layer 210 that surrounds the elongate body of material 202 along its length to provide additional structural security to the flavor container 200. The outer wrapper layer 210 may comprise any suitable material, for example, paper. In some examples, the outer wrapper layer 210 is configured so that its acts as a liquid resistant barrier that prevents liquid, for example, condensation that forms around the flavor container 200 when it is in use, from getting into the interior of the flavor container 200 and making the flavor container soggy. In examples in which the flavor component 208 is a capsule that is manipulated by hand to release a flavor liquid or gel, the outer wrapper layer 210 prevents a user's fingers getting coated in the liquid or gel and acts to retain the liquid or gel in the flavor container 200. In one example, a liquid resistance wrapper layer 210 comprises paper impregnated with a barrier material or Natureflex or other suitable thin polymer film or plastic. The wrapper may have information printed on it, for example, an indication of a flavor type.

Figure 3:
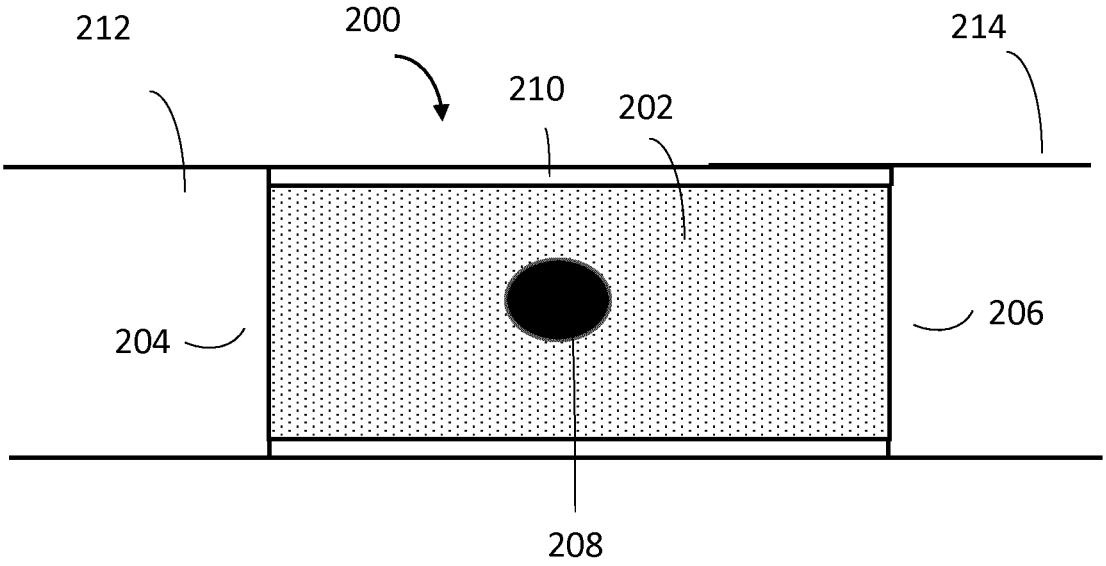
FIG. 3 shows a schematic sectional view of another example of a flavor container.

Referring now to FIG. 3, in some examples, the flavor container 200 may further comprise a hollow tube portion 212 extending from the region of the 'upstream' end 204 and/or a hollow tube portion 214 extending from the region of the 'downstream' end 206. If the hollow tube portion 212 extending from the region of the 'upstream' end 204 is present, then, this may be used to affix the flavor container 200 to the mouthpiece 102 of the smoking device 1. If the hollow tube portion 214 extending from the region of the 'downstream' end 206 is present, then, this tube portion 226 may itself be used as a mouthpiece by a user of the device 100. Either tube portion 212 or 214 may comprise any suitable material, for example, paper, cardboard, plastic or CA.

It is envisaged that after a certain number of draws, for example 20-50, the flavor of a flavor container 200 will be exhausted and at this point a user may replace a used flavor container 200 in a device 100 with a replacement flavor container 200. Replacement flavor containers 200 may of course be provided in packs. Each flavor container 200 may therefore be used over the course of multiple use sessions of the smoking device 1.

In some examples, sufficient liquid 116 is provided in the liquid container 114 to last multiple user sessions. In some examples, the liquid container 114 is arranged so that it can be re-filled or topped up with fresh liquid 116 by a user when the user so chooses. In other examples, a user cannot access the liquid container to 114 to add liquid to it and so in some examples, when the liquid 116 provided in the liquid container 114 is depleted or runs low a user may simply replace the used cartridge 108 with a new one.

In some examples, the cartridge 108 and the container 200 may be provided in combination together as a consumable that can be connected to, but removable from, the battery portion 112. This consumable may be designed to be a single session consumable (or at least limited number of sessions consumable) in that it contains sufficient liquid 116 and sufficient flavor substance in the container 200 to last a single user session (or limited number of user sessions) after which the user disposes of the consumable and replaces it with a new one.

Although in the examples described above, the container 200 is a flavor container and contains a substance for modifying a flavor of the aerosol when the aerosol flows through the body of material, this is not essential and instead (or in addition) the container 200 may contain a substance for modifying a property of the aerosol other than (or in addition) to flavor.

In some examples, the container 200 may contain a substance that modifies one or more other organoleptic properties of the aerosol (e.g. modifying the feel or smell or look of the aerosol to the user).

In some examples, the container 200 may contain a substance that modifies the PH of the aerosol by either lowering or raising the PH (e.g. modifying the acidity or the basicity of the aerosol).

In some examples, the container 200 may contain a substance that modifies (e.g. reduce) the amount of aldehydes in the aerosol.

In some examples, the container 200 may contain a substance that modifies different combinations of two or more of these or indeed other properties of the aerosol.

Although in the above described examples, the device 100 generates the aerosol by heating a liquid (the device is of type commonly referred to as an e-cig), this is not essential and in other examples, the device may generate the aerosol by heating, but not burning, a material, that may contain for example tobacco (e.g. a device sometimes referred to as a Tobacco Heating Product (THP) device).

Indeed, in any of the examples, the device 100 may include any suitable material for generating the aerosol and be in any suitable form, for example, a gel.

It will be appreciated that the container 200 may be provided in packs containing multiple containers As used herein, the terms "flavor" and "flavorant" may refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, solid, or powder. For example, a liquid, oil, or other such fluid flavorant may be impregnated in a porous solid material so as to impart flavor and/or other properties to that porous solid material. As such, the liquid or oil is a constituent of the material in which it is impregnated.

The above embodiments are to be understood as illustrative examples of the invention. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. An aerosol provision device for providing an inhalable medium comprising an aerosol, comprising:

a mouthpiece;

a substance container having a body of material having a single fiber Denier value in the range of 8 to 12 that is permeable so as to allow the aerosol generated in the aerosol provision device to flow into and through the body of material, wherein a length of the body of material is in a range of 10 mm to 20 mm; and a substance in the body of material for modifying a property of the aerosol when the aerosol flows through the body of material, a first tube portion extending away from one end of the body of material and a second tube portion extending away from another end of the body of material, wherein the first tube portion is located upstream of the substance container and the first tube portion removably connects the substance container to the mouthpiece of the aerosol generating device;

a further container for holding a liquid or a material from which aerosol is generatable; and a heater for volatilizing the liquid or the material held in the further container to generate a flow of an aerosol in use or for heating but not combusting material to generate a flow of an aerosol in use, wherein, the substance container is arranged, so that in use, a pressure difference across the length of the body of material, when a user takes a draw is in the range of 0 to 40 mm water gauge (wg).

2. The aerosol provision device of claim 1, wherein the body of material is a fibrous material.

3. The aerosol provision device of claim 1, wherein the body of material comprises at least one of cellulose acetate (CA), polypropylene, polyester or paper.

4. The aerosol provision device of claim 1, wherein a cross section of the body of material has a diameter that is in a range of 5 mm to 9 mm.

5. The aerosol provision device of claim 1, further comprising a wrapping layer around the body of material.

6. The aerosol provision device of claim 5, wherein the wrapping layer is impermeable to water.

7. The aerosol provision device of claim 1, further comprising at least one capsule comprising the substance.

8. The aerosol provision device of claim 7, wherein the at least one capsule is breakable or squeezable to release the substance.

9. The aerosol provision device of claim 1, wherein the substance is a liquid or a gel.

10. The aerosol provision device of claim 1, wherein the substance is for modifying an organoleptic property of the aerosol.

11. The aerosol provision device of claim 1, wherein the substance is for modifying a flavor of the aerosol.

12. The aerosol provision device of claim 1, wherein the substance is for modifying a pH of the aerosol.

* * * * *